US005409781A

United States Patent [19]

Rösler et al.

[11] Patent Number: 5,409,781

[45] Date of Patent: Apr. 25, 1995

[54] HIGH-TEMPERATURE COMPONENT, ESPECIALLY A TURBINE BLADE, AND PROCESS FOR PRODUCING THIS COMPONENT

[75] Inventors: Joachim Rösler, Unterehrendingen; Manfred Thumann, Ennetbaden; Christoph Tönnes, Birmenstorf, all of Switzerland

[73] Assignee: Asea Brown Boveri Ltd., Baden, Switzerland

[21] Appl. No.: 70,933

[22] Filed: Jun. 4, 1993

[30] Foreign Application Priority Data

Jun. 13, 1992 [DE] Germany ..... 42 19 470.9

[51] Int. Cl.[6] ..... B32B 15/02

[52] U.S. Cl. ..... 428/547; 428/548; 428/567; 428/569

[58] Field of Search ..... 428/547, 548, 553, 567, 428/569; 419/6, 8, 48, 49, 51

[56] References Cited

U.S. PATENT DOCUMENTS

| | | | |
|---|---|---|---|
| 2,431,660 | 11/1947 | Gaudenzi | 253/77 |
| 2,946,680 | 7/1976 | Ramont | 75/200 |
| 3,940,268 | 2/1976 | Catlin | 75/208 R |
| 3,992,200 | 11/1976 | Chandhok | 75/211 |
| 4,063,939 | 12/1977 | Weaver et al. | 75/208 R |
| 4,097,276 | 6/1978 | Six | 75/208 R |
| 4,101,712 | 7/1978 | Bomford | 428/547 |
| 4,294,615 | 10/1981 | Blackburn et al. | 75/175.5 |
| 4,323,394 | 4/1982 | Hoffmuller et al. | 75/208 R |
| 4,329,175 | 5/1982 | Turner | 75/208 R |
| 4,383,809 | 5/1983 | Hoffmuller | 425/78 |
| 4,445,259 | 5/1984 | Ekbom | 29/156.8 B |
| 4,492,737 | 1/1985 | Conolly | 428/552 |
| 4,526,747 | 7/1985 | Schimmel et al. | 419/8 |
| 4,663,241 | 5/1987 | Doherty et al. | 428/547 |
| 4,680,160 | 7/1987 | Helmink | 419/6 |
| 4,808,249 | 2/1989 | Eylon et al. | 148/133 |
| 4,828,793 | 5/1989 | Froes et al. | 419/6 |
| 4,851,190 | 7/1989 | Bowen et al. | 419/66 |
| 4,897,127 | 1/1990 | Huang | 148/133 |
| 4,900,635 | 2/1990 | Bowen et al. | 428/547 |
| 5,190,603 | 3/1993 | Nazmy et al. | 148/671 |
| 5,226,985 | 7/1993 | Kim et al. | 148/671 |

FOREIGN PATENT DOCUMENTS

| | | |
|---|---|---|
| 2136170 | 12/1972 | France . |
| 2239214 | 2/1973 | Germany . |
| 2302202 | 9/1976 | Germany . |
| 2122353 | 7/1977 | Germany . |
| 28138892 | 10/1978 | Germany . |
| 2737248 | 3/1979 | Germany . |
| 2834222 | 11/1980 | Germany . |
| 2813892 | 4/1981 | Germany . |
| 3307791 | 10/1983 | Germany . |
| 3241926 | 5/1984 | Germany . |
| 3543831 | 6/1989 | Germany . |
| 4010076 | 10/1990 | Germany . |
| 4022403 | 1/1991 | Germany . |
| 4037959 | 6/1991 | Germany . |
| 4121215 | 1/1992 | Germany . |
| 4121228 | 1/1992 | Germany . |
| 608766 | 9/1948 | United Kingdom . |

OTHER PUBLICATIONS

"Turbinenschaufel mit hoher Warm-und Zunderfestigkeit, insbesondere fur Gasturbinen, sowie Verfahren zu ihrer Herstellung", R. Kieffer, 1/52, pp. 1-7.

*Primary Examiner*—Donald P. Walsh
*Assistant Examiner*—Chrisman D. Carroll
*Attorney, Agent, or Firm*—Burns, Doane, Swecker & Mathis

[57] ABSTRACT

A turbine blade including a blade and blade foot. The blade foot is formed by a ductile material and the blade comprises a material which is brittle compared to the ductile material but resistant to high temperature. The two materials are alloys of the same base compositions but differ as to presence and/or quantity of at least one doping element. The alloys can be hot-compacted with the formation of a transition zone joining the blade and blade root wherein fine crystallites of the blade root interpenetrate coarse crystallites of the blade. The two materials can comprise a gamma-titanium aluminide containing 0.5 to 8 atomic percent of a dopant. The turbine blade exhibits outstanding mechanical properties at high temperatures, good ductility at room temperature and a long service life.

9 Claims, 2 Drawing Sheets

HIGH-TEMPERATURE COMPONENT, ESPECIALLY A TURBINE BLADE, AND PROCESS FOR PRODUCING THIS COMPONENT

BACKGROUND OF THE INVENTION

1. Field of the Invention

The invention relates to a high-temperature component, especially a turbine blade, having a component body containing at least one first section and a second section, in which component body the first section is formed by a ductile material and the second section has a material which is brittle as compared with the ductile material. The invention also relates to a process for producing such a component.

2. Discussion of Background

A turbine blade component and a process for producing such a component are described in FR-A1-2,136,170. The component is designed as a turbine blade and is intended for use in a gas turbine. It has a blade root cast from a eutectic alloy and a blade body containing a blade leaf. The blade root is formed by a ductile casting having a non-directional structure. The blade leaf consists of a matrix and of fibrous crystals which are aligned parallel to one another in the longitudinal direction of the blade and which are embedded in the matrix and are formed by directional solidification from an inductively heated melt. As compared with the blade root, the blade leaf is distinguished by a substantially higher creep strength, with a considerably reduced ductility. Particularly in the case of producing a large blade leaf, however, it is difficult to reach a temperature gradient which is sufficiently large for a directional solidification and hence to reach the desired high creep strength in the blade leaf.

SUMMARY OF THE INVENTION

The invention, provides a novel component, especially a turbine blade, which is distinguished by a long service life when used in a device operated at medium and high temperatures, such as especially a turbine, and at the same time to provide an approach which allows such a component to be manufactured in a simple manner suitable for mass production.

The component according to the invention is distinguished from comparable components according to the state of the art by a long service life. The reason for this is, on the one hand, that sections of the component, which are subject to different stresses, including in particular the blade root or blade leaf, consist of alloys of different specifications adapted to the different requirements. Since these alloys, adapted to the stepwise graduated properties of the component such as, in particular, the turbine blade, contain a common base material, no chemical reaction products occur in the boundary region of the sections. The sections therefore merge into one another without a sharp transition, so that the component according to the invention can fully absorb, without any problems, the high thermal and mechanical stresses which arise in a graduated manner in the operation of a thermal engine such as, in particular, a gas turbine or a compressor, The process used for producing the components according to the invention is distinguished by the fact that even large components of high thermal and mechanical load-carrying ability can be produced by conventional process steps, such as especially by hot-isostatic pressing or by sintering, in a simple manner suitable for mass production.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
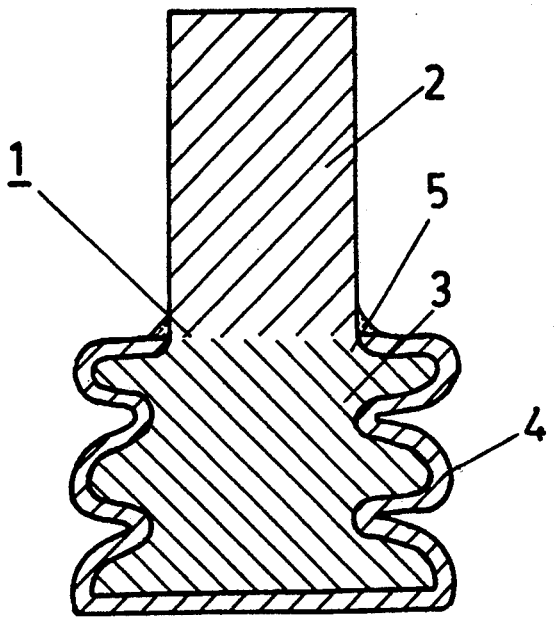
FIG. 1 shows a plan view of a section, made in the longitudinal direction, through a first variant of a component according to the invention, designed as a turbine blade, after termination of a hot-isostatic pressing step carried out in the production process.
Figure 2:
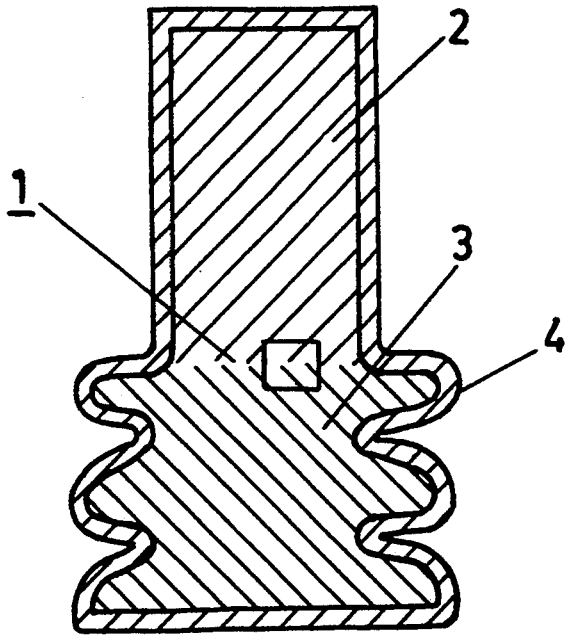
FIG. 2 shows a plan view of a section, made in the longitudinal direction, through a second variant of a component according to the invention, designed as a turbine blade, after termination of a hot-isostatic pressing step carried out during production.

Referring now to the drawings, wherein like reference numerals designate identical or corresponding parts throughout the several views, the components shown in FIGS. 1 and 2 and each designed as a turbine blade 1 each contain an elongate blade leaf 2 and a blade root 3 formed on one end of the blade leaf 2. Reference numeral 4 designates a press can. In the embodiment according to FIG. 1, this press can surrounds the blade root 3 and has an opening 5 which is filled by the blade leaf 2 and is preferably sealed gas-tight by welding or soldering the press can 4 to the blade leaf 2. In the embodiment according to FIG. 2, the press can 4 surrounds the entire turbine blade 1.

The turbine blade 1 shown in FIG. 1 is produced as follows:

One end of a casting made as a blade leaf 2 is passed through the opening 5 into the press can 4. The press can 4 preferably consisting of steel is soldered or welded gas-tight to the casting in the region of the opening 5. Through a further opening, which is not shown, of the press can 4, a cavity, receiving the blade root of the turbine blade 1, of the press can 4 is filled with alloy powder. The press can 4 is then evacuated and sealed gas-tight.

The materials for the casting and the powder each contain one of two alloys, derived from a common base material, of different chemical compositions which differ from one another by the presence and/or the quantity of at least one doping material alloyed with the base material. The base material used is preferably an intermetallic phase-such as, in particular, a gammatitanium aluminide. At least one of the two alloys containing gamma-titanium aluminide contains a proportion of at least 0.2 and at most 8 atom per cent of doping material such as, for example, one or more of the elements B, C, Co, Cr, Ge, Hf, Mn, Mo, Nb, Pd, Si, Ta, V, Y, W and Zr.

A typical alloy for the blade leaf 2 has, for example, the following composition:

In atom %: 48 Al—3 Cr—remainder Ti and impurities;

In % by weight: 33.2 Al—3.9 Cr—impurities less than 0.5—remainder Ti.

The size of the powder particles is typically smaller than 500 μm.

A further typical alloy for the blade leaf has the following composition, in atom %:

48 Al—2 Cr—2 Ta—remainder Ti and impurities.

A typical alloy for the blade root 3 has, for example, the following composition:

In atom %: 48 Al—2 Cr—2 Nb—remainder Ti and impurities;

In % by weight: 32.5 Al—2.9 Cr—5 Nb—impurities less than 0.5—remainder Ti.

The size of the powder particles is typically smaller than 200 μm, preferably smaller than 100 μm.

A further typical alloy for the blade root has the following composition, in atom %:

48 Al—2 Cr—2 Ta—0.5 Si—remainder Ti and impurities.

The specimen finished by gas-tight sealing of the press can 4 is transferred into a pressing device and hot-isostatically compacted at temperatures between 900° and 1200° C. A typical pressing step at about 1070° C. took about 3 hours at a pressure of about 250 MPa. In this case, the two alloys were compacted pore-free with a gradual transition from the blade leaf 2 to the blade root 3, without chemical reaction products having been formed in the boundary region.

This composite material, already showing the shape of the turbine blade, was, after removal of-the deformed press can 4, then heat-treated typically for about 4 hours at temperatures above 700° C. Subsequently, the turbine blade according to the invention was finished by slight machining, such as grinding, polishing and/or electrochemical treatment.

In producing the turbine blade 1 which can be seen in FIG. 2, a press can 4 widened in the longitudinal direction and taking up the entire turbine blade 1 was used. Initially, the casting forming the blade leaf 2 was put into this press can 4 which was then filled with the alloy powder, in accordance with the illustrative embodiment described above. The press can 4 was then evacuated and sealed gas-tight. The specimen thus produced was treated in accordance with the illustrative embodiment described above. The alloys used had the same composition as in the illustrative embodiment described above.

In place of a casting forming the blade leaf 2, a body of a hot-isostatically compacted powder can also be introduced into the press can 4. In a further alternative embodiment of the invention, the alloy powder used to form the blade leaf, having 48 atom per cent of Al and 3 atom per cent of Cr, the remainder being Ti and small quantities of impurities, was hot-isostatically compacted for about 3 hours at a temperature of about 1070° C. and a pressure of about 250 MPa. The resulting body was then put into the press can 4 shown in FIG. 2 and, under the conditions described with the latter, hot-isostatically compacted together with the alloy powder forming the blade root 3, having 48 atom per cent of Al, 2 atom per cent of Cr and 2 atom per cent of Nb, the remainder being Ti and small quantities of impurities. The compacted body was then, in accordance with the illustrative embodiment described above, also heat-treated and finished.

In further variants of the invention, the press can 4 was filled in each case with an alloy powder, forming the blade leaf 2, of the chemical composition indicated above, in place of the casting or of the body formed from hot-compacted powder. This was then backfilled with an alloy powder, forming the blade root 3, having the composition indicated in the illustrative embodiments described above. The press can 4 was then, without shaking and without mixing of the powders filled in with one another, evacuated and sealed gastight. By hot-isostatic pressing for about 3 hours at about 1070° C. and a pressure of about 250 MPa, a porefree material was produced, from which, after removal of the press can 4, a turbine blade according to the invention was produced after heat treatment at about 1350° C. for two hours and finishing with removal of material. A turbine blade formed in this way can also be seen, correspondingly to the abovementioned embodiment variants, in FIG. 2.

Figure 3:
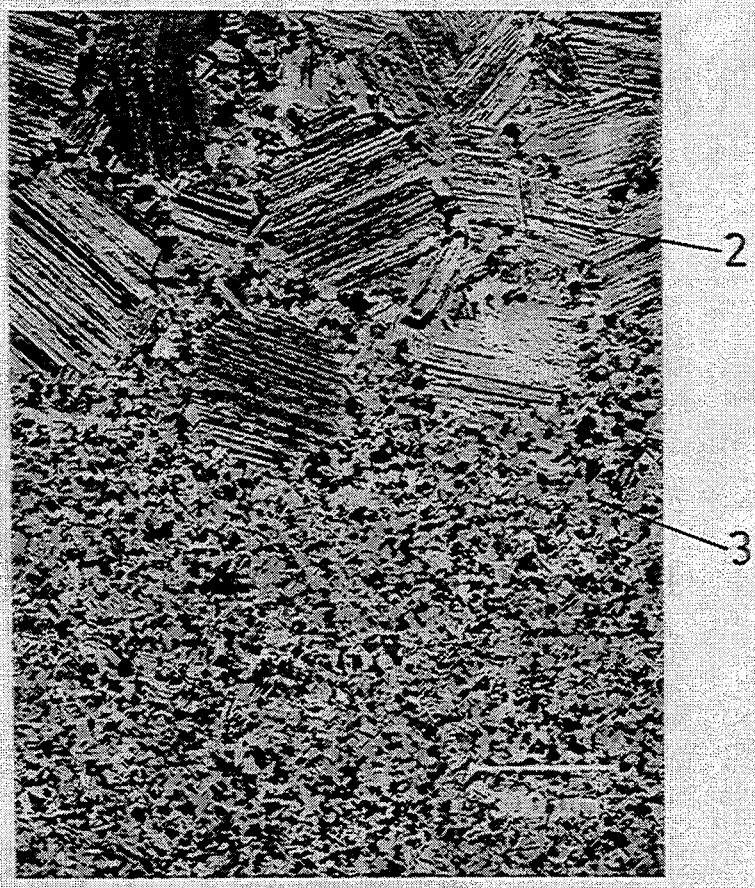
FIG. 3 shows a ground section of the zone, shown edged in the second variant of the component according to the invention.

The build-up and the microstructure of a part, enclosed in a box in FIG. 2, of a turbine blade according to the invention produced as described above exclusively from alloy powders, can be seen in the section according to FIG. 3. This shows that the alloy forming the blade leaf 2 has a coarse-grained microstructure and the alloy forming the blade root 3 has a fine-grained microstructure, and that there is no undesired reaction zone with chemical reaction products or with precipitations in the transition zone between the two alloys. The two alloys show a gradual transition with interpenetration of coarse and fine crystallites.

Examinations of the material, on which the turbine blade 1 according to the invention is based, gave the following properties:

The alloy forming the blade leaf 2 has at room temperature a ductility of about 0.5%, but the alloy forming the blade root 3 has a ductility of 2.1%. At a temperature of about 700° C., the blade leaf 2 has a creep strength which, corrected for density, is considerably above the creep strength of the nickel-based superalloys normally used in this temperature range. The complete turbine blade 1 shows a ductility of 0.5%, corresponding to the material of the blade leaf 2. Its mechanical and thermal properties are not impaired by the transition zone between the two alloys. The turbine blade 1 according to the invention is accordingly distinguished by a blade root 3 of high ductility and by a blade leaf 2 which, though brittle at room temperature, has a high creep strength at high temperatures. The strength in the transition region is, because of the base material common to both alloys and the absence of brittle reaction products, sufficient to guarantee safe operation of the turbine blade 1 at high temperatures.

In a further variant of the invention, it is possible, in place of a press can 4 as a mold for taking up the alloys, to use a sintering mold and to achieve the compaction to give the turbine blade by means of a sintering process.

The invention is not restricted to turbine blades. It also concerns other components which are highly stressed mechanically at high temperatures, such as, for example, integrally formed turbine wheels of turbochargers, Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A turbine blade, which can be exposed to high temperatures, comprising a blade formed from a first material which is ductile and a blade formed from a second material which is brittle compared with the first material, the first and second materials comprising first and second alloys of different chemical compositions which have been hot-compacted with the formation of a transition zone joining the blade and the blade, each of the first and second alloys being a gamma titanium aluminide containing a proportion of at least 0.5 and at most 8 atomic percent of a doping material, the first and second alloys differing from each other with respect to at least one of the doping material and amount of the doping material, the blade having a microstructure which is more coarse than a grain structure of the blade and the transition zone including interpenetration of fine crystallites of the blade with coarse crystallites of the blade sufficient to ensure reliable operation of the turbine blade at high temperature.

2. The turbine blade of claim 1, wherein the doping material comprises one or more elements selected from the group consisting of B, C, Co, Cr, Ge, Hf, Mn, Mo, Nb, Pd, Si, Ta, V, Y, W and Zr.

3. The turbine blade of claim 1, wherein the doping material of the blade includes at least one element selected from the group consisting of Cr, Mn, V, and Si.

4. The turbine blade of claim 1, wherein the doping material of the blade includes at least one element selected from the group consisting of Nb, Ta and W.

5. The turbine blade of claim 1, wherein the second alloy includes Cr or Cr and Ta as the doping material.

6. The turbine blade of claim 1, wherein the first alloy includes Cr and Nb as the doping material.

7. The turbine blade of claim 1, wherein the first alloy includes Cr, Ta and Si as the doping material.

8. The turbine blade of claim 1, wherein the first and second alloys comprise sintered powder having a particle size of less than 200 nm.

9. The turbine blade of claim 1, wherein the transition zone comprises gradual interpenetration of the coarse and fine crystallites.

* * * * *